US011263949B2

(12) United States Patent
Chen et al.

(10) Patent No.: US 11,263,949 B2
(45) Date of Patent: Mar. 1, 2022

(54) DISPLAY PANEL, CONTROL METHOD THEREOF, AND DISPLAY APPARATUS

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Gaowei Chen, Beijing (CN); Jiaqiang Wang, Beijing (CN); Chao Yu, Beijing (CN); Shengwei Yang, Beijing (CN); Jinlong Zheng, Beijing (CN); Xiaojuan Gao, Beijing (CN); Xiance Liu, Beijing (CN); Fuan Zhu, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 16 days.

(21) Appl. No.: 16/651,051

(22) PCT Filed: Oct. 18, 2019

(86) PCT No.: PCT/CN2019/111967
§ 371 (c)(1),
(2) Date: Mar. 26, 2020

(87) PCT Pub. No.: WO2020/181767
PCT Pub. Date: Sep. 17, 2020

(65) Prior Publication Data

US 2021/0225245 A1 Jul. 22, 2021

(30) Foreign Application Priority Data

Mar. 14, 2019 (CN) ..... 201910192805.3

(51) Int. Cl.
*G09G 3/20* (2006.01)

(52) U.S. Cl.
CPC ... *G09G 3/2003* (2013.01); *G09G 2300/0443* (2013.01)

(58) Field of Classification Search
CPC ..... G09G 3/2003; G09G 2300/0443; G09G 3/3406; G02F 1/13357; G02F 1/1333;
(Continued)

(56) References Cited

U.S. PATENT DOCUMENTS

2006/0290644 A1* 12/2006 Kim ..... G09G 3/3677 345/100
2008/0165102 A1 7/2008 Tsai et al.
(Continued)

FOREIGN PATENT DOCUMENTS

CN 104407479 A 3/2015
CN 105575318 A 5/2016
(Continued)

OTHER PUBLICATIONS

International Search Report dated Jan. 16, 2020, issued in counterpart Application No. PCT/CN2019/111967. (12 pages).
(Continued)

*Primary Examiner* — Amare Mengistu
*Assistant Examiner* — Gloryvid Figueroa-Gibson
(74) *Attorney, Agent, or Firm* — Westerman, Hattori, Daniels & Adrian, LLP

(57) ABSTRACT

A display panel, a control method and a display apparatus are provided. The display panel includes a first display area having a notched boundary and a second display area. The first display area includes a first pixel unit group comprising X white sub-pixel or sub-pixels and Y first single color sub-pixels, and the second display area includes a second pixel unit group comprising Y second single color sub-
(Continued)

pixels, where X is an integer of at least 1 and Y is an integer of at least 1.

19 Claims, 10 Drawing Sheets

(58) Field of Classification Search
CPC .... G02F 1/1339; G02F 1/1362; G02F 1/1368; G02F 1/136286; G02F 1/133602; G02F 1/136209; G02F 1/13338; G02F 1/1336; F21V 8/00; G02B 6/0035; H04M 1/0266; H04M 1/02
USPC ..... 345/690, 1.1
See application file for complete search history.

(56) References Cited

U.S. PATENT DOCUMENTS

| | | | | |
|---|---|---|---|---|
| 2011/0164076 | A1* | 7/2011 | Lee | G09G 3/3406 345/691 |
| 2017/0178577 | A1 | 6/2017 | Hirota et al. | |
| 2019/0293975 | A1* | 9/2019 | Cheng | G02F 1/1336 |
| 2021/0072592 | A1* | 3/2021 | Tang | G02F 1/136286 |

FOREIGN PATENT DOCUMENTS

| | | | |
|---|---|---|---|
| CN | 107633802 | A | 1/2018 |
| CN | 107808627 | A | 3/2018 |
| CN | 107863061 | A | 3/2018 |
| CN | 107994054 | A | 5/2018 |
| CN | 108279523 | A | 7/2018 |
| CN | 108711404 | A | 10/2018 |
| CN | 108717244 | A | 10/2018 |
| CN | 108761874 | A | 11/2018 |
| CN | 208076869 | U | 11/2018 |
| CN | 108957849 | * | 12/2018 |
| CN | 108957849 | A | 12/2018 |
| CN | 109283726 | A | 1/2019 |
| CN | 109697952 | A | 4/2019 |

OTHER PUBLICATIONS

Office Action dated Mar. 31, 2020, issued in counterpart CN Application No. 201910192805.3, with English Translation. (19 pages).

* cited by examiner

Related Art

DISPLAY PANEL, CONTROL METHOD THEREOF, AND DISPLAY APPARATUS

CROSS-REFERENCE TO RELATED APPLICATIONS

This application claims benefit of the filing date of Chinese Patent Application No. 201910192805.3 filed on Mar. 14, 2019, the disclosure of which is hereby incorporated in its entirety by reference.

TECHNICAL FIELD

The present disclosure relates to the field of display technologies, and in particular, to a display panel, a control method thereof, and a display apparatus.

BACKGROUND

Customer expectations and perceptions on display products are on the rise, and plenty of recent technological innovation is endeavoring to meet the increasing demands. In recent years, a high screen-to-body ratio has attracted great attention and gain popularity in consumer displays. Full-screen or all-screen displays lead the trend in many new releases. The full-screen front not only is an appealing feature but also allows more display content for better user experience.

BRIEF SUMMARY

One embodiment of the present disclosure is a display panel. The display panel may include a first display area having a notched boundary and a second display area. The first display area may include a first pixel unit group comprising X white sub-pixel or sub-pixels and Y first single color sub-pixels, and the second display area may include a second pixel unit group comprising Y second single color sub-pixels, where X is an integer of at least 1 and Y is an integer of at least 1.

Optionally, Y may be equal to 3. The Y first single color sub-pixels may include a red sub-pixel, a green sub-pixel and a blue sub-pixel, and/or the Y second single color sub-pixels may include a red sub-pixel, a green sub-pixel and a blue sub-pixel.

Optionally, sub-pixels of adjacent rows may be arranged differently in the first display area. One of the adjacent rows may include the red sub-pixel, the green sub-pixel, the blue sub-pixel, and the white sub-pixel in this order, and the other one of the adjacent rows may include the white sub-pixel, the blue sub-pixel, the red sub-pixel, and the green sub-pixel in this order. In a same column, the red sub-pixel and the green sub-pixel may correspond to the white sub-pixel and the blue sub-pixel of adjacent rows.

Optionally, X may be equal to 1, and Y may be an odd number greater than or equal to 3. The first pixel unit group may include (X+Y)/2 first sub-pixel groups. One of the first sub-pixel groups may include a white sub-pixel and a first single color sub-pixel and each of the other of the first sub-pixel groups may include two first single color sub-pixels.

Optionally, X may be equal to Y. The first pixel unit group may include X first sub-pixel groups and each of the X first sub-pixel groups may include a white sub-pixel and a first single color sub-pixel.

Optionally, both X and Y may be equal to 3, and each of the X first sub-pixel groups may include a white sub-pixel and one of a red sub-pixel, a green sub-pixel, or a blue sub-pixel.

Optionally, an area of the first pixel unit group may be smaller or equal to an area of the second pixel unit group. An area of the white sub-pixel may be smaller than an area of each of the second single color sub-pixels.

Optionally, the area of the first pixel unit group may be equal to the area of the second pixel unit group. The area of the white sub-pixel may be a half of the area of each of the second single color sub-pixels.

Optionally, an area of each of the second single color sub-pixels may be larger than an area of one of the first single color sub-pixels.

Optionally, a sub-pixel density in the first display area may be twice a sub-pixel density of the second display area.

Optionally, first pixel unit groups in adjacent rows may have the same arrangement in the first display area.

Optionally, each of the white sub-pixels, the first single color sub-pixels, and the second single color sub-pixels may have a shape of a square, a rectangle, or a rhombus.

Optionally, the display panel may further include a plurality of intersected scan lines and data lines, a plurality of first switches and a plurality of second switches. Two sub-pixels in a first sub-pixel group may be respectively connected to a first switch and a second switch. A control terminal of the first switch and a control terminal of the second switch may be respectively connected to two different scan lines. A first terminal of the first switch and a first terminal of the second switch may be respectively connected to different data lines.

Optionally, the first switch and the second switch each may include a transistor.

Another embodiment of the present disclosure is a control method for controlling the display panel. The method may include supplying driving signals to scan lines of the display panel to drive the first display area and the second display area.

Optionally, a duration time of each of the driving signals of the scan lines in the first display area may be the same, and a duration time of each of the driving signals of the scan lines in the second display area may be the same.

Optionally, the duration time of each of the driving signals of the scan lines in the first display area may be shorter than the duration time of each of the driving signals of the scan lines in the second display area.

Optionally, the duration time of each of the driving signals of the scan lines in the first display area may be one half of the duration time of each of the driving signals of the scan lines in the second display area.

Another embodiment of the present disclosure is a display apparatus. The display apparatus may include the display panel.

Optionally, the display apparatus may be a mobile terminal comprising a sensor assembly. The first display area may include a notch for accommodating the sensor assembly, and the notch may constitute the notched boundary.

BRIEF DESCRIPTION OF THE DRAWINGS

The drawings are used to provide a further understanding of the technical solutions of the present disclosure, and constitute a part of the specification, which together with the embodiments of the present disclosure are used to explain the technical solutions of the present disclosure, and do not constitute a limitation of the technical solutions of the present disclosure.

DETAILED DESCRIPTION

The present disclosure will be described in further detail with reference to the accompanying drawings. It should be noted that, in the case of no conflict, the features in the embodiments and the embodiments in the present disclosure may be combined in any suitable manner in any one or more embodiments or examples.

The steps illustrated in the flowchart of the figures may be executed in a computer system such as a set of computers capable of executing instructions. Also, although logical sequences are shown in the flowcharts, in some cases the steps shown or described may be performed in a different order than the ones described herein.

Unless otherwise defined, technical terms or scientific terms used in the present disclosure are intended to be in the ordinary meaning of those of ordinary skill in the art. The words "first," "second" and similar words used in the present disclosure do not denote any order, quantity or importance, but are merely used to distinguish different components. The words "including" or "comprising" and the like mean that the element or the item preceding the word includes the element or item listed after the word and its equivalent and do not exclude other components or objects. "Coupled," "connected" and the like are not limited to physical or mechanical connections, but may include electrical connections, whether direct or indirect. "Upper," "lower," "left," "right," etc. are only used to indicate relative positional relationships, and when the absolute position of the object being described is changed, the relative positional relationship may also change accordingly.

Those skilled in the art understand that the transistors employed in all embodiments of the present disclosure may be thin film transistors or field effect transistors or other devices having the same characteristics. Preferably, the thin film transistor used in the embodiment of the present disclosure may be an oxide semiconductor transistor. Since the source and drain of the transistor used here are symmetrical, the source and drain thereof can be interchanged.

Figure 1:
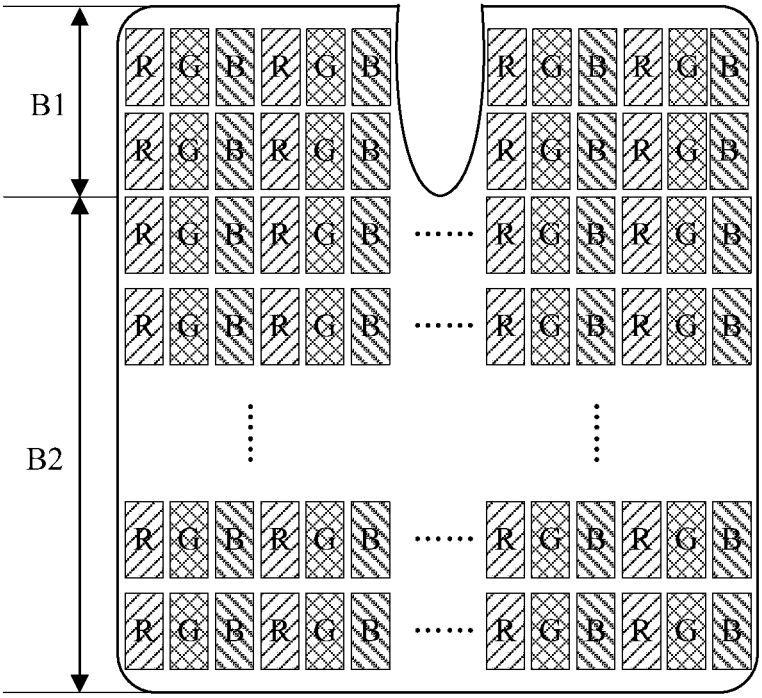
FIG. 1 is a schematic diagram of a display panel in the related art.

The full-screen design usually employs notches in the display panel to accommodate components such as cameras, earpieces, and so on. FIG. 1 shows a schematic view of a display panel in the related art. The display panel includes a notched area B1 and a normal display area B2. The two areas have different electrical loads. Therefore, the display panel may suffer uneven brightness across the areas B1 and B2, thereby resulting in undesirable display effects.

It should be noted that FIGS. 1-5 and 9 are illustrative only and do not indicate that there are only two rows of pixels in the notched area or any specific number of rows and columns of pixels in the notched area and the normal display area. In practice, the number of rows and columns of pixels in the notched area and the normal display area may vary.

Figure 2:
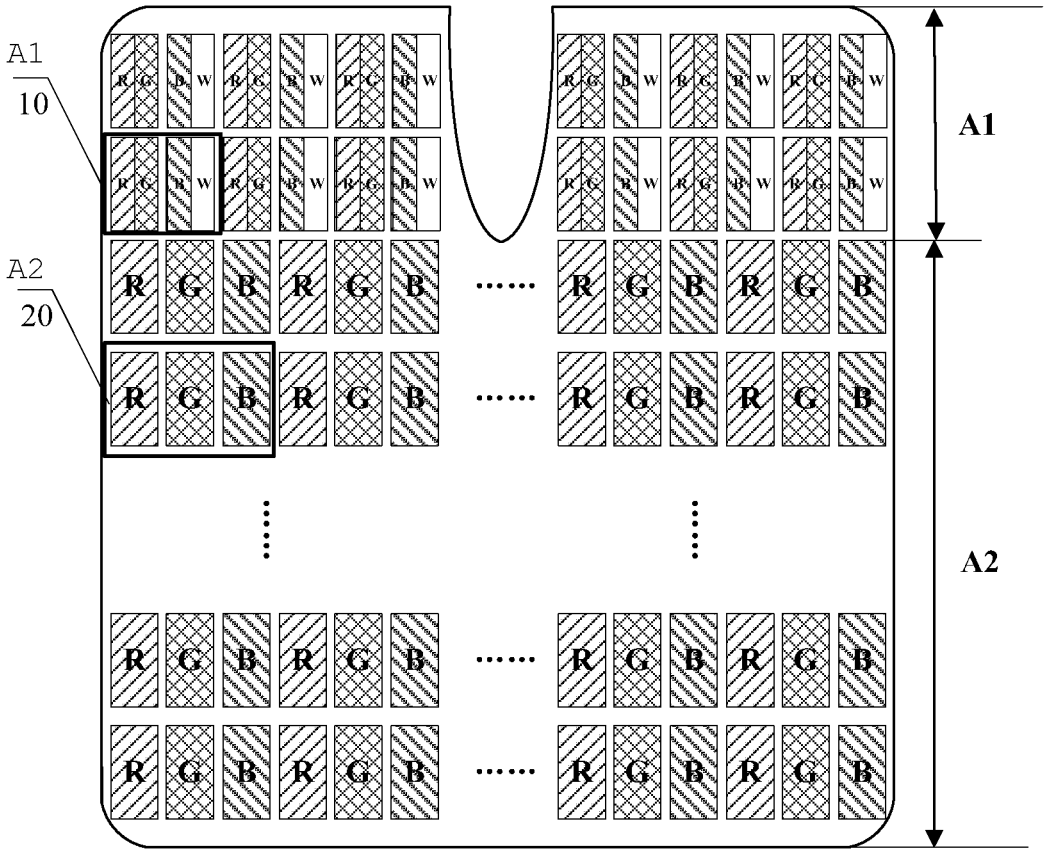
FIG. 2 is a schematic diagram of a display panel according to some embodiments of the present disclosure.

FIG. 2 illustrates a schematic diagram of a display panel according to some embodiments of the present disclosure. The display area of the display panel is divided into a first display area A1 and a second display area A2. The first display area A1 includes a notch with a notched boundary. The first display area A1 includes a plurality of first pixel unit groups 10, and each first pixel unit group 10 includes X white sub-pixels and Y first single color sub-pixels. The second display area A2 includes a plurality of second pixel unit groups 20, and each second pixel unit group 20 includes Y second single color sub-pixels, where $X \geq 1$ and $Y \geq 1$.

Optionally, as shown in FIG. 2, the first display area A1 and the second display area A2 are disposed adjacent to each other in a vertical direction, and the embodiments of the present disclosure do not limit to this.

The first display area A1 according to one embodiment of the present disclosure includes a plurality of the first pixel unit groups in M rows and N columns. The second display area A2 includes a plurality of the second pixel unit groups in S rows and T columns. M, N, S, and T are integers of at least 1. Optionally, FIG. 2 shows the first pixel unit groups arranged in M=2 rows and N=6 columns. In the embodiment of the present disclosure, the values of the M and N are determined according to actual requirements. Similarly, the values of the S and T are determined according to actual requirements. The embodiments of the present disclosure do not limit thereto.

In one embodiment, the number of white sub-pixels in the first pixel unit group of the first display area A1 may be one or more, which is determined according to actual requirements. FIG. 2 is an exemplary illustration that the first pixel unit group includes one white sub-pixel. It should be noted that the values of X and Y are determined according to actual requirements. The embodiments of the present disclosure do not limit thereto.

In addition, in a specific implementation of the display panel in one embodiment of the present disclosure, the first single color sub-pixels in the first pixel unit group have the same shape and area. The shape and area of the white sub-pixels may depend on actual requirements. The second single color sub-pixels in the second pixel unit group have the same shape and area. The embodiments of the present disclosure do not limit thereto.

Since the transmittance of the white sub-pixel is higher than the transmittance of the first single color sub-pixel, arranging the white sub-pixels in the first display area can effectively adjust the brightness of the first display area. If the first display area is darker than the second display area, the white sub-pixels in the first display area may be turned on to increase the brightness of the first display area. As such, the brightness difference between the first display area and the second display area is reduced. Conversely, if the first display area is brighter than the second display area, the white sub-pixels of the first display area may be turned off to decrease the brightness of the first display area. Accordingly, the brightness difference between the first display area and the second display area is reduced.

In one embodiment, the display panel may be applied to a liquid crystal display (LCD) panel or an organic light-emitting diode (OLED) panel, but shall not be limited thereto. Since the full screen of an LCD panel generally has R corners at which the backlight module of the liquid crystal display panel has no light source, the R corners are generally dark. Moreover, it is difficult to compensate this by adjustment compensation through the light guide plate in the backlight module, which also may cause bright sideline problems. Thus, the embodiment of the present disclosure including the white sub-pixels in the first display area can solve the display panel bright sideline problems due to the structural limitation of the backlight module.

In addition, it should be noted that when one customizes the full-screen display panel, the size of the display panel is first determined to fit the size of the whole machine. Thus, the first pixel unit group near the contour of the notched boundary may not necessarily include a complete set of sub-pixels. The first pixel unit group near the contour of the notched boundary may include some of the sub-pixels in the first pixel unit group. The embodiments of the present disclosure do not limit thereto.

In some embodiments of the present disclosure, the display area of the display panel is divided into a first display area and a second display area. The first display area has a notched boundary and the first display area includes first pixel unit groups; wherein the first pixel unit groups includes X white sub-pixels and Y first single color sub-pixels. The second display area includes second pixel unit groups, and the second pixel unit group includes Y second single color sub-pixels; wherein $X \geq 1$, $Y \geq 1$. Since the white sub-pixels are placed in the first display area, the pixel arrangement of the first display area and the second display area are different, so as to reduce the brightness difference between the first display area and the second display area and thus improve the display performance.

In one embodiment, Y is equal to 3, and the second pixel unit group has a conventional RGB structure, and the first pixel unit group and the second pixel unit group each includes a red sub-pixel, a green sub-pixel or a blue sub-pixel.

Optionally, in the display panel according to some embodiments of the present disclosure, to effectively improve the actual display resolution and the picture quality, the first single color sub-pixel has the same shape and area as the white sub-pixel. The same shape and area of the sub-pixels in each of the first pixel unit group ensure the uniformity of the display color. It should be noted that the shape and the area of the first single color sub-pixel and those of the white sub-pixel may be respectively different, and are determined according to actual requirements. The embodiments of the present disclosure do not limit thereto.

Optionally, the shape of the first single color sub-pixel and/or the white sub-pixel is one of a square, a rectangle, or a rhombus. For example, FIG. 2 illustrates rectangular sub-pixels. The present disclosure does not limit thereto.

Optionally, as shown in FIG. 2, the shape and area of each of the second single color sub-pixels in the second display area are respectively the same, and the shape of the second sub-pixel is one of a square, a rectangle or a rhombus. The embodiments of the present disclosure do not limit thereto.

Optionally, in one embodiment, as shown in FIG. 2, X is equal to 1 and Y is an odd number greater than or equal to 3. The first pixel unit group 10 includes one white sub-pixel, and the first pixel unit group 10 include $(X+Y)/2$ first sub-pixel groups; wherein one of the first sub-pixel groups includes a white sub-pixel and a first single color sub-pixel, and the other of the first sub-pixel groups include two first single color sub-pixels.

In one embodiment, as shown in FIG. 2, Y=3. The first first sub-pixel group includes a white sub-pixel and a first single color sub-pixel. The first pixel unit group includes two first sub-pixel groups. It should be noted that the first sub-pixel group including a white sub-pixel and a first single sub-pixel in the embodiment may be placed in other positions. The present disclosure does not limit thereto.

Optionally, as shown in FIG. 2, the first first sub-pixel group includes a red sub-pixel and a green sub-pixel, and the second first sub-pixel group includes a blue sub-pixel and a white sub-pixel.

Figure 3:
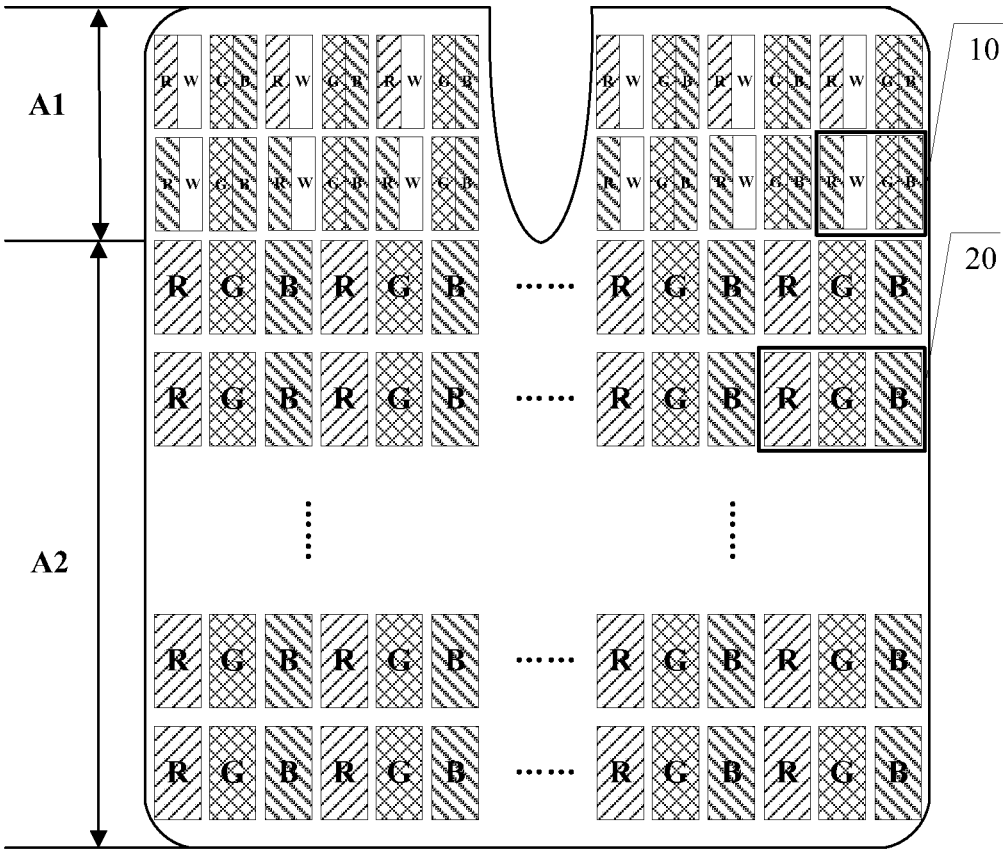
FIG. 3 is a schematic diagram of a display panel according to some embodiments of the present disclosure.

FIG. 3 shows a schematic diagram of a display panel according to some embodiment of the present disclosure. As shown in FIG. 3, the first first sub-pixel group includes a red sub-pixel and a white sub-pixel, and the second first sub-pixel group includes a green sub-pixel and a blue sub-pixel. In addition, the first sub-pixel group may further include a red sub-pixel and a green sub-pixel, and the second first sub-pixel group may further include a white sub-pixel and a blue sub-pixel. The embodiments of the present disclosure do not limit thereto as long as the first pixel unit group includes Y first single color sub-pixels and a white sub-pixel. The arrangement is determined according to actual requirements, and the embodiments of the present disclosure do not limit thereto.

Optionally, in one embodiment, X is equal to Y, that is, the number of first single color sub-pixels is the same as the number of white sub-pixels in the first pixel unit group.

Figure 4:
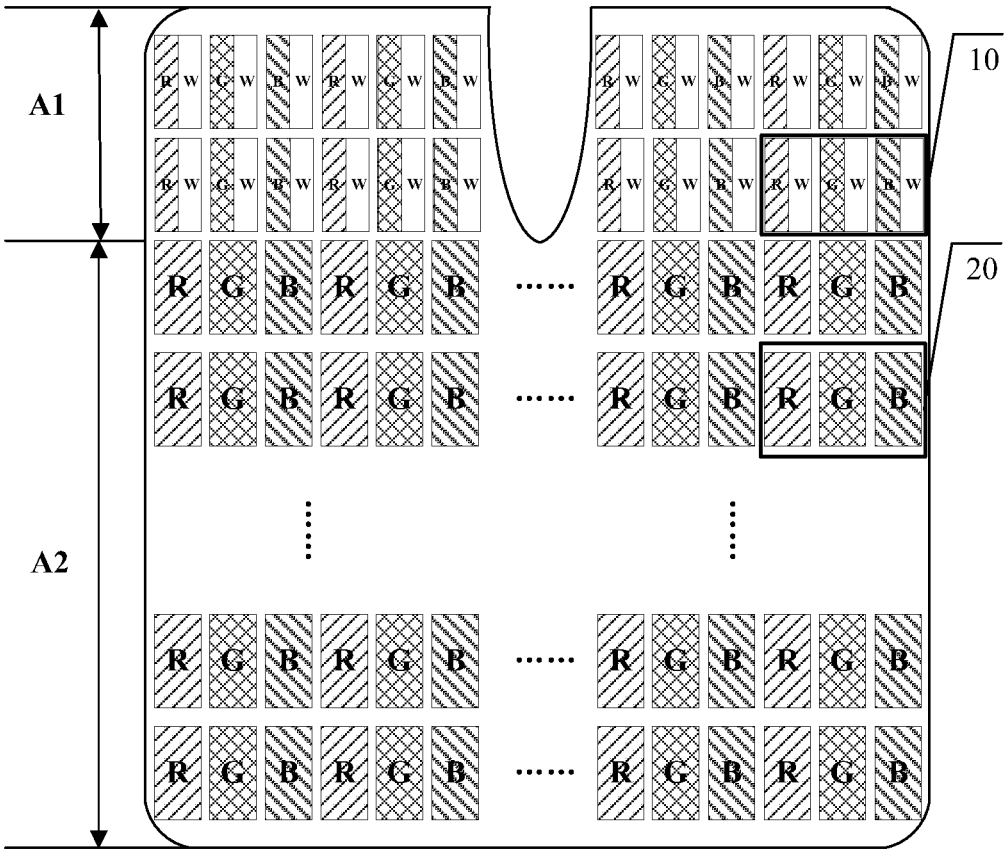
FIG. 4 is a schematic diagram of a display panel according to some embodiments of the present disclosure.

FIG. 4 shows a display panel according to some embodiments of the present disclosure. The first pixel unit group 10 includes X first sub-pixel groups. Each of first sub-pixel groups includes a white sub-pixel and a first single color sub-pixel. The first single color sub-pixels in different first sub-pixel groups may not have the same color.

It should be noted that FIG. 4 only presents X=3 as an example. As shown in FIG. 4, the first sub-pixel group includes a red sub-pixel R and a white sub-pixel W, the second first sub-pixel group includes a green sub-pixel G and a white sub-pixel W, and the third first sub-pixel group includes a blue sub-pixel B and a white sub-pixel W. In one embodiment, as long as the colors of the first single color sub-pixels in the different first sub-pixel groups are different, the arrangement of the single color sub-pixels is determined according to actual requirements.

In one embodiment, the area, A1, of the first pixel unit group 10 is smaller than or equal to the area, A2, of the second pixel unit group 20, and/or the area of the white sub-pixel is smaller than the area of the second single color sub-pixel. For example, FIG. 2 and FIG. 3 show that the area A1 of the first pixel unit group 10 is smaller than the area A2 of the second pixel unit group 20, and FIG. 4 shows that the area A1 of the first pixel unit group 10 is equal to the area A2 of the second pixel unit group 20. The area of the first pixel unit group or the second pixel unit group includes areas of all sub-pixels included and the areas between the adjacent sub-pixels.

Optionally, the area of the white sub-pixel is equal to ½ of the area of the second single color sub-pixel, and the area of the first sub-pixel group is equal to the area of the second single color sub-pixel. That is, the area of the second single color sub-pixel is equal to the sum of the area of the white sub-pixel and the area of the first single color sub-pixel.

It should be noted that the area of the white sub-pixel is smaller than the area of the second single color sub-pixel, which prevents large gaps between the single color sub-pixels caused by the white sub-pixels. The large gaps may affect human visual perception, and reducing such gaps improves the display effect. The area of the sub-pixel generally refers to the effective illuminating area. In an LCD, the area of the sub-pixel may refer to the opening area defined by the black matrix (BM). In an OLED, the area of the sub-pixel may refer to the opening area of defined by the pixel define layer (PDL).

Optionally, the area of the white sub-pixel is equal to ¾ of the area of the second single color sub-pixel, and the area of the first pixel unit group is equal to the area of the second pixel unit group.

Optionally, the arrangement of the first pixel unit groups in the adjacent rows may be the same or different in the first display area. It should be noted that FIGS. 2, 3 and 4 show the same arrangement of adjacent first pixel unit groups in the first display area.

Figure 5A:
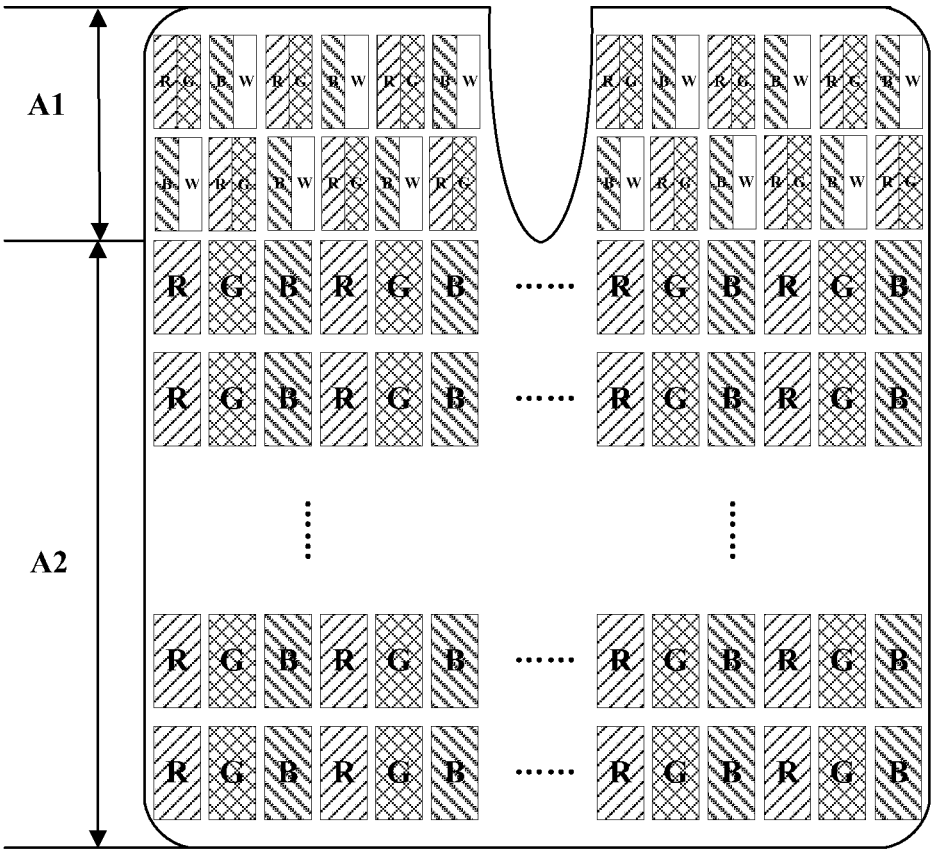
FIG. 5A is a schematic diagram of a display panel according to some embodiments of the present disclosure.
Figure 5B:
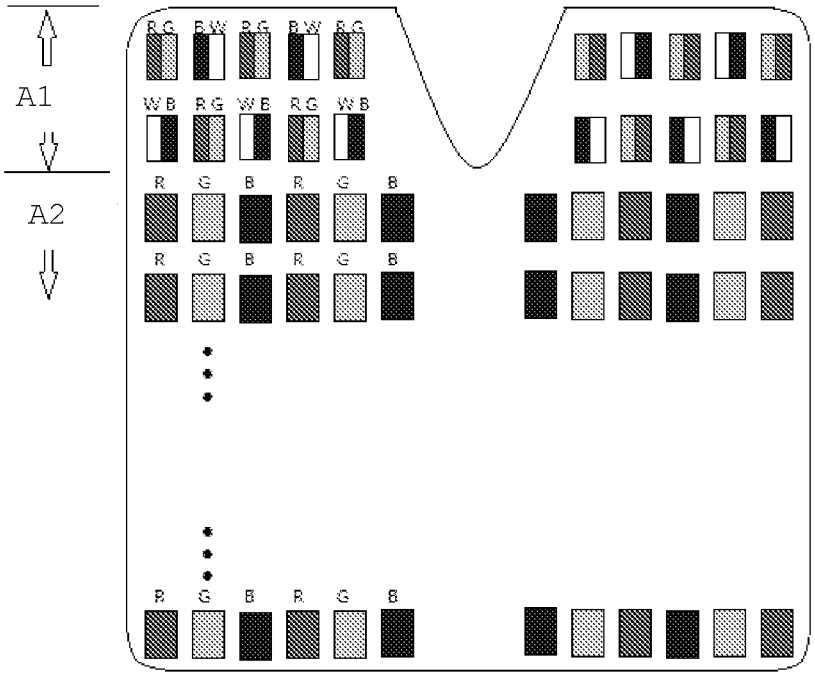
FIG. 5B is a schematic diagram of a display panel according to some embodiments of the present disclosure.

The sub-pixels of adjacent rows are arranged differently in the first display area. FIG. 5A is a schematic diagram of the display panel according to some embodiments of the present disclosure. As shown in FIG. 5A, the arrangement of the first pixel unit groups in the adjacent rows is different in order to ensure the display effect of the display panel and avoid placing the white sub-pixels of the adjacent two rows in the same column. The arrangement avoids the effect of white lines caused by the white sub-pixels as the white sub-pixels illuminate during display, thereby further improving the display effect. In one embodiment, as shown in FIG. 5B, the first pixel unit groups in the adjacent rows employ RGBW/WBRG layout, thereby ensuring maximal color uniformity. That is, if the sub-pixels in one row are arranged in the order of the red sub-pixel, the green sub-pixel, the blue sub-pixel, and the white sub-pixel (RGBW), the sub-pixels in the adjacent rows are arranged in the order of the white sub-pixel, the blue sub-pixel, the red sub-pixel, and the green sub-pixel (WBRG). In the same column, the red sub-pixel and the green sub-pixel (RG) correspond to the white sub-pixel and the blue sub-pixel (WB) of the adjacent rows.

Further, in one embodiment, in order to reduce the cost of modifying the display panel, the data lines are unchanged, the dual scan line and data line are used in the first display area to achieve individual control of each sub-pixel in the first pixel unit group while not affecting the original wiring layout of the second display area.

Figure 6:
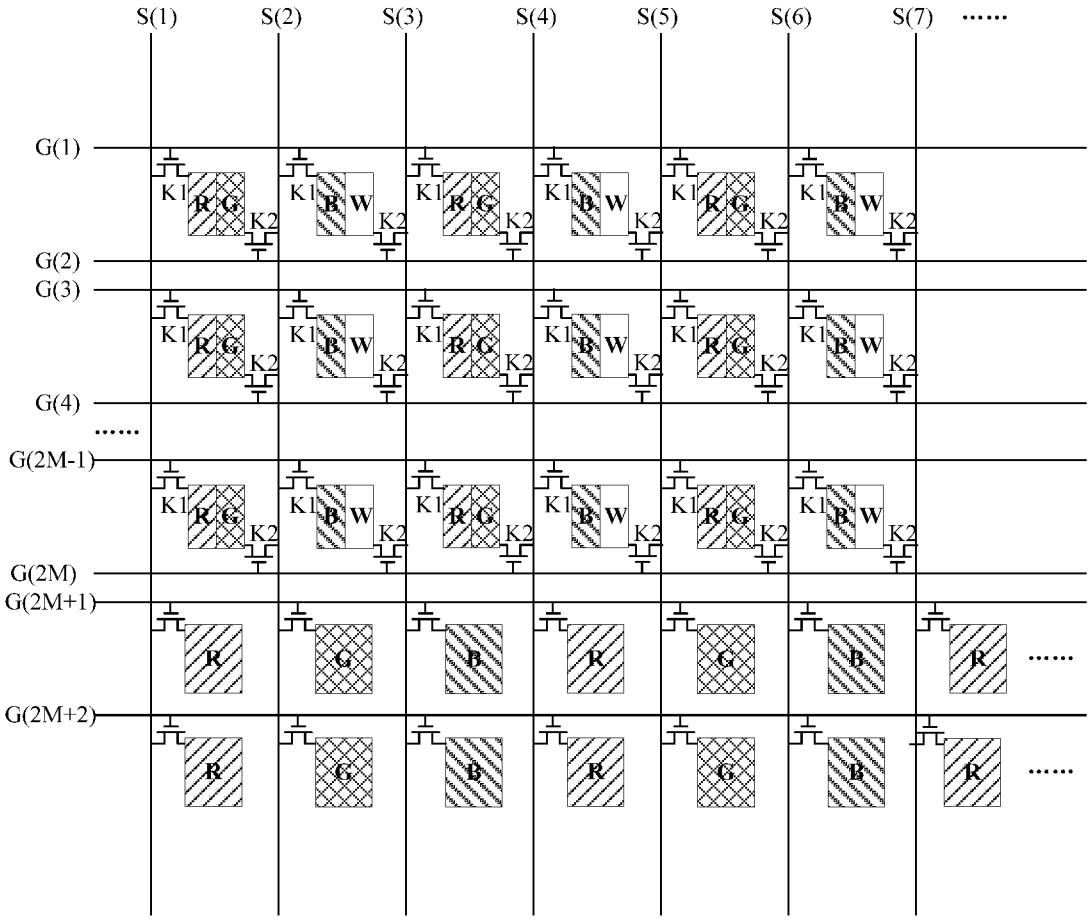
FIG. 6 is a schematic diagram of a display panel according to some embodiments of the present disclosure.

Taking X=1 as an example, FIG. 6 shows a schematic diagram of a display panel according to some embodiments of the present disclosure. The display panel includes a plurality of intersected scan lines and data lines, and a plurality of first switches K1 and a plurality of second switches K2. Two sub-pixels in the first sub-pixel group are respectively connected to the second terminal of the first switch and the second terminal of the second switch, the control terminal of the first switch and the control terminal of the second switch are respectively connected to different scan lines, and the first terminal of the first switch and the first terminal of the second switch are respectively connected to different data lines.

In the embodiment, the display panel includes 2M+S rows of scan lines and T columns of data lines. The display panel further includes first switches K1 and second switches K2. Two sub-pixels in each of the first sub-pixel groups are connected to the first switch K1 and the second switch K2, respectively.

In one embodiment, in the first pixel unit group of the i-th row and the j-th column, the first sub-pixel of the first first sub-pixel group is connected to the (2i−1)th row scan line G(2i−1) and the (2i−1)th column data line S(2i−1) through the first switch K1, and the second sub-pixel of the first first sub-pixel group is connected to the 2i-th row scan line G(2i) and the 2i-th column data line S(2i) through the second switch K2, respectively. The first sub-pixel of the second first sub-pixel group is respectively connected to the 2i−1th row scan line G(2i−1) and the 2i-th column data line S(2i) through the first switch K1, and the second sub-pixel of the second first sub-pixel group is respectively connected to the 2i-th row scanning line G(2i) and the (2i+1)-th column data line S(2i+1) through the second switch K2, where $1 \le i \le M$, $1 \le j \le T$.

In one embodiment, the first sub-pixel of the first first sub-pixel group of the first pixel unit group in the first row and the first column is connected to the first row scan line G(1) and the first column data line S(1) through the first switch K1, and the second sub-pixel thereof is respectively connected to the second row scan line G(2) and the second column data line S(2) through the second switch K2. The first sub-pixel in the second first sub-pixel group is connected to the first row scan line G(1) and the second column data line S(2) through the first switch K1, and the second sub-pixel in the second first sub-pixel group is connected to the second row scanning line G(2) and the third column data line S(3), and so on.

Optionally, the first switch K1 and the second switch K2 may be transistors, and FIG. 6 illustrates the first switch and the second switch as transistors.

In some embodiments of the present disclosure, each of the first pixel unit groups is controlled by two rows of scanning lines that implement individual control to each sub-pixel.

Figure 7:
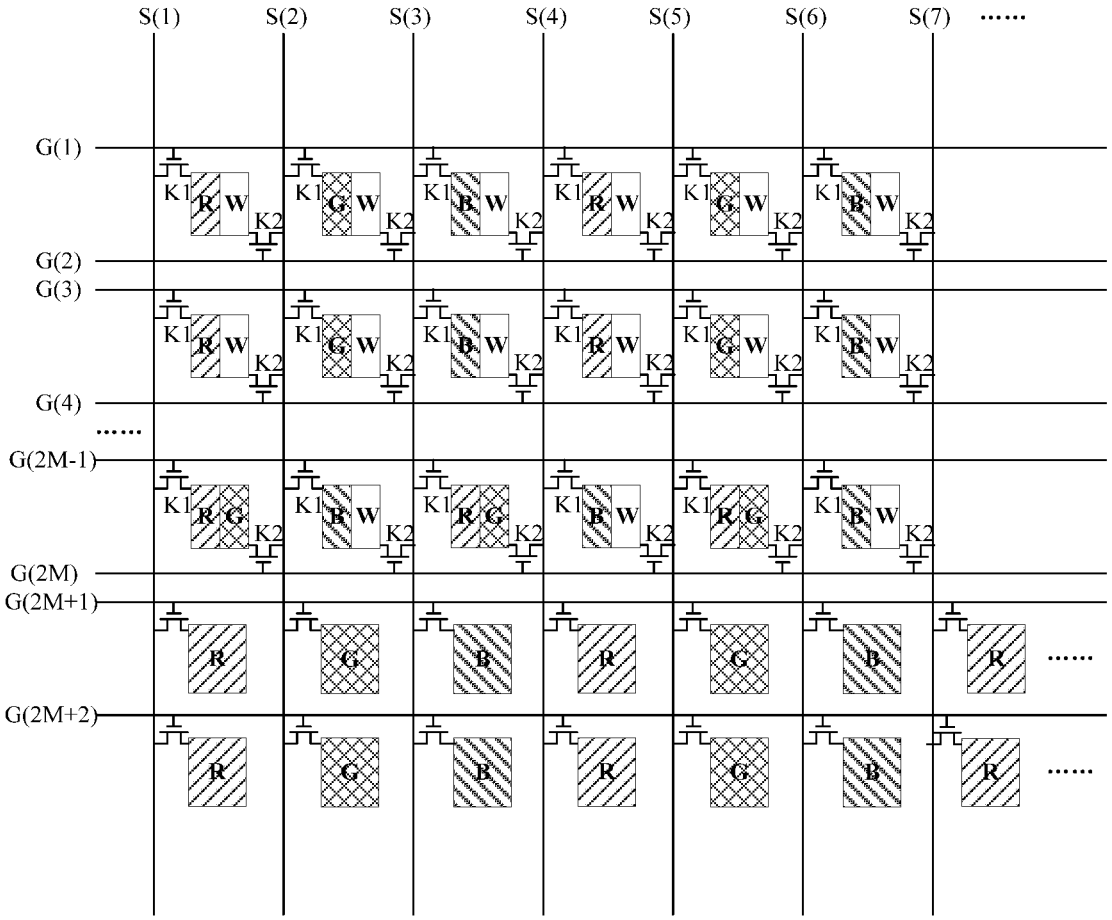
FIG. 7 is a schematic diagram of a display panel according to some embodiments of the present disclosure.

As shown in FIG. 7, for example, as X=3, the display panel includes 2M+S rows of scan lines and T columns of data lines. The display panel further includes first switches K1 and second switches K2, wherein two sub-pixels in each first sub-pixel group are respectively connected to the first switch K1 and the second switch K2.

In one embodiment, in the first pixel unit in the i-th row and the j-th column, the first sub-pixel of the first first sub-pixel group is connected through the first switch K1 to the 2i−1th row scan line G(2i−1) and the 3i−2th column data line S(3i−2), respectively; the second sub-pixel of the first first sub-pixel group is connected to the 2i-th row scan line G(2i) and the 3i−1th column data line S(3i−1) through the second switch K2. The first sub-pixel of the second first sub-pixel group is connected to the (2i−1)th row scan line G(2i−1) and the (3i−1)th column data line S(3i−1) through the first switch K1, and the second sub-pixel of the second first sub-pixel group is connected to the 2i-th row scan line G(2i) and the 3i-th column data line S(3i) through the second switch K2, respectively. The first sub-pixel of the third sub-pixel group is connected to the 2i−1th row scan line G(2i−1) and 3i column data line S (3i) respectively through the first switch K1, and the other sub-pixel is connected to the 2i-th row scan line G(2i) and the (3i+1)-th column data line S(3i+1) through the second switch K2, respectively, where $1 \le i \le M$, $1 \le j \le T$.

In one embodiment, the first sub-pixel of the first first sub-pixel group in the first pixel unit group in the first row and the first column is connected to the first row scan line G(1) and the first column data line S(1) through the first switch K1; and the second sub-pixel of the first first sub-pixel group in the first pixel unit group in the first row and the first column is respectively connected to the second row scan line G(2) and the second column data line S(2) through the second switch K2. The first sub-pixel in the second first pixel group is connected to the first row scan line G(1) and the second column data line S(2) through the first switch K1; and the second sub-pixel in the second first pixel group is connected to the second row scan line G(2) and the third column data line S(3) through the second switch K2. The first sub-pixel of the third first sub-pixel group is connected to the first row scan line G(1) and the third column data line S(3) through the first switch K1; and the second sub-pixel of the third first sub-pixel group is connected to the second row scan line G(2) and the fourth column data line S(4) through the second switch K2, and so on.

Optionally, the first switch K1 is used to control the connected sub-pixels to be turned on. The first switch K1 may be a P-type or an N-type transistor, which is not limited in the embodiments of the present disclosure.

Optionally, the second switch K2 is used to control the connected sub-pixels to be turned on. The second switch K2 may be a P-type or an N-type transistor, which is not limited in the embodiments of the present disclosure.

Another embodiment of the present disclosure further provides a control method for the display panel. The control method of the display panel includes:

providing driving signals to scan lines of a display panel to drive the display of the first display area and the second display area.

The control method is used to control the display panel according to some embodiments of the present disclosure, and the mechanism and the implementation effect thereof are similar, and details are not described herein again.

In one embodiment, the duration of each of the driving signals of the scanning lines located in the same display area is the same, and the duration of each of the driving signals of the scanning lines located in the first display area is shorter than the duration of each of the driving signals of the scanning lines located in the second display area.

Figure 8:
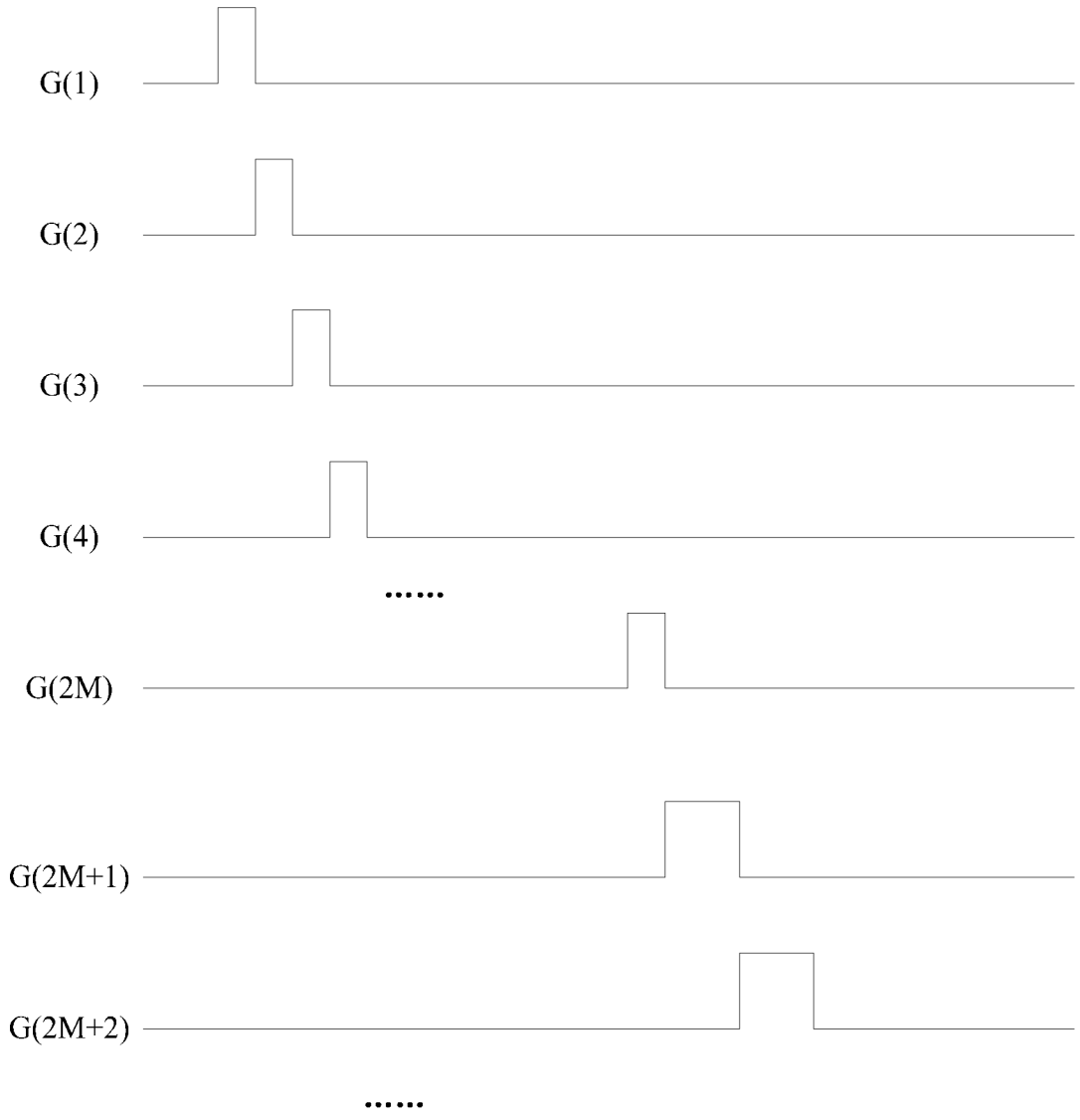
FIG. 8 is a timing chart of scanning lines according to some embodiments of the present disclosure.

Optionally, FIG. 8 is a timing diagram of scan line signals according to some embodiments of the present disclosure. The driving signals of the first row to the 2M-th row of scan lines have the same duration, and the driving signals of the scanning lines from the (2M+1)th row to the (2M+S)th row have the same duration.

The signal duration of the scan line of the i-th row is shorter than the signal duration of the scan line of the j-th row, where $1 \leq i \leq 2M$, $2M+1 \leq j \leq 2M+S$. It should be noted that the signal duration of the scan line of the i-th row is related to the relationship between the area of the white sub-pixel and the area of the second single color sub-pixel.

Optionally, if the area of the white sub-pixel is ½ of the display area of the second single color sub-pixel, the signal duration of the scan line of the i-th row is equal to ½ of the signal duration of the scan line of the j-th row.

In one embodiment, the display area of the sub-pixel in the first display area is a half of the display area of the sub-pixel of the second display area. In case that the display requirement is satisfied, the charging time of the data line of the first display area can reduce theoretically to a half. Assuming that the charging time of each sub-pixel of the second display area is 10 μs, and the turning-on time of each scanning line is 10 μs. But the charging time of the sub-pixel of the first display area is reduced in a half, so the turning-on time of each scanning line is 5 μs. Due to each row of the sub-pixels being connected to dual scan lines, the charging time of each row of sub-pixels of the first display area is the same as the charging time of each row of sub-pixels of the second display area. In general, the charging time of each line of data lines remains the same as the original.

Another embodiment of the present disclosure further provides a display apparatus, including the display panel according to some embodiments of the present disclosure. The implementation of the display apparatus may refer to the embodiments of the display panel, and is not repeated herein.

The display apparatus may be used in a liquid crystal display, an organic electroluminescence display, a cathode radiation tube display, a plasma display apparatus, an electronic paper or an electroluminescence display, but not limited thereto. The display apparatus can be any product or component having a display function, such as a mobile phone, a tablet computer, a television, a display, a notebook computer, a digital photo frame, a navigator, and so on. Other required components related to the display apparatus are understood by those skilled in the art, are not described herein, and should not be construed to limit the present disclosure.

Figure 9:
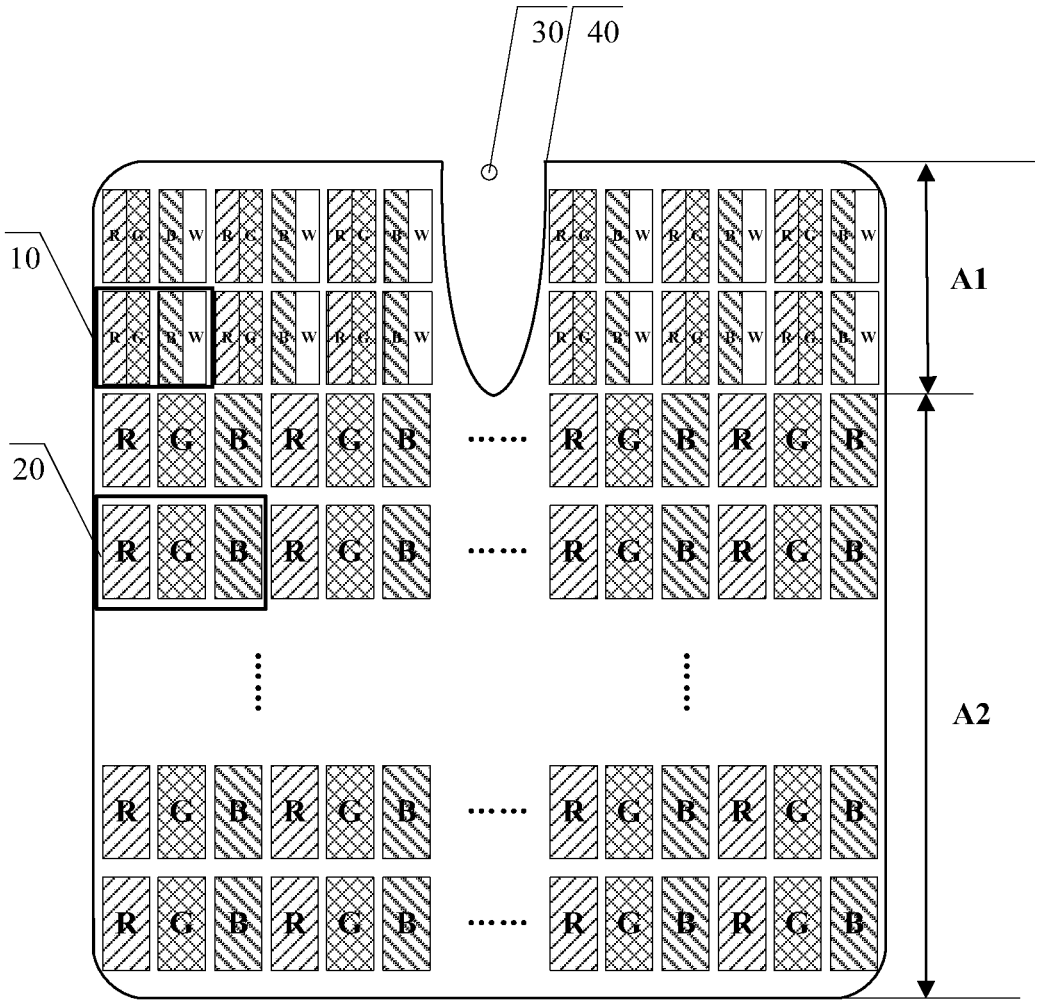
FIG. 9 is a schematic diagram of a display apparatus according to some embodiments of the present disclosure.

FIG. 9 is a schematic diagram of a display apparatus according to some embodiments of the present disclosure. The display apparatus is a mobile terminal, and the mobile terminal includes a sensor assembly 30. The first display area A1 has a notch 40 for the sensor assembly 3. The notch 40 constitutes a notched boundary in the first display area A1.

In one embodiment, the notch 40 is formed at an upper side of the display panel, and the notch 40 includes two chamfer segments that are connected to the upper frame of the display panel and a concave arc segment that is located between the two chamfer segments and is smoothly connected to the two chamfer segments. Alternatively, the shape of the notch 40 is not limited as long as the sensor assembly can be placed in the notch. In order to improve the screen ratio of the full screen, it is preferable that the size of the notch is as small as possible. The present disclosure does not make any limit thereto.

Optionally, the sensor assembly according to some embodiments of the present disclosure may be placed on the light incident side of the mobile terminal. The sensor assembly may at least include a light intensity sensor, a distance sensor, an image sensor, and so on. The distance sensor may be an infrared sensor and the image sensor may be a front camera.

The drawings of the embodiments of the present disclosure relate to the structures involved in the embodiments of the present disclosure, and other structures may refer to the general design.

In the case of no conflict, the embodiments of the present disclosure or the features in the embodiments may be combined to obtain a new embodiment.

While the embodiments of the present disclosure have been described above, the described embodiments are merely provided for the purpose of understanding the disclosure and are not intended to limit the disclosure. Any modification and variation in the form and details of the embodiments may be made by those skilled in the art without departing from the spirit and scope of the disclosure. The scope defined by the appended claims shall prevail.

What is claimed is:

1. A display panel, comprising:

a first display area having a notched boundary, and a second display area;

a plurality of intersected scan lines and data lines;

wherein the first display area comprises a first pixel unit group comprising X white sub-pixel or sub-pixels and Y first single color sub-pixels, the second display area comprises a second pixel unit group comprising Y second single color sub-pixels, X is an integer of at least 1 and Y is an integer of at least 1;

the first display area locates at two sides of a notch;

a sub-pixel density in the first display area is twice a sub-pixel density of the second display area;

two sub-pixels are disposed between two adjacent data lines in one row of the first display area, and one sub-pixel is disposed between the two adjacent data lines in one row of the second display area; and each of the data lines between two adjacent sub-pixels provides a data signal to the two adjacent sub-pixels in one row of the first display area and provides the data signal to one of the two adjacent sub-pixels in one row of the second display area.

2. The display panel according to claim 1, wherein Y is equal to 3, the Y first single color sub-pixels comprise a red sub-pixel, a green sub-pixel and a blue sub-pixel, and/or the Y second single color sub-pixels comprise a red sub-pixel, a green sub-pixel and a blue sub-pixel.

3. The display panel according to claim 2, wherein sub-pixels of adjacent rows are arranged differently in the first display area, one of the adjacent rows comprises the red sub-pixel, the green sub-pixel, the blue sub-pixel, and the white sub-pixel in this order, and other one of the adjacent rows comprises the white sub-pixel, the blue sub-pixel, the red sub-pixel, and the green sub-pixel in this order, and in a same column, the red sub-pixel and the green sub-pixel correspond to the white sub-pixel and the blue sub-pixel of adjacent rows.

4. The display panel according to claim 2, wherein an area of the first pixel unit group is smaller or equal to an area of the second pixel unit group; and an area of the white sub-pixel is smaller than an area of each of the second single color sub-pixels.

5. The display panel according to claim 4, wherein the area of the first pixel unit group is equal to the area of the second pixel unit group; and the area of the white sub-pixel is a half of the area of each of the second single color sub-pixels.

6. The display panel according to claim 2, wherein an area of each of the second single color sub-pixels is larger than an area of one of the first single color sub-pixels.

7. The display panel according to claim 2, wherein first pixel unit groups in adjacent rows have the same arrangement in the first display area.

8. The display panel according to claim 2, wherein each of the white sub-pixels, the first single color sub-pixels, and the second single color sub-pixels has a shape of a square, a rectangle, or a rhombus.

9. The display panel according to claim 1, wherein X is equal to 1, Y is an odd number greater than or equal to 3; the first pixel unit group comprises (X+Y)/2 first sub-pixel groups; and one of the first sub-pixel groups comprises a white sub-pixel and a first single color sub-pixel and each of the other of the first sub-pixel groups comprises two first single color sub-pixels.

10. The display panel according to claim 1, wherein X is equal to Y; the first pixel unit group comprises X first sub-pixel groups; each of the X first sub-pixel groups comprises a white sub-pixel and a first single color sub-pixel.

11. The display panel according to claim 10, wherein both X and Y are equal to 3, and each of the X first sub-pixel groups comprises a white sub-pixel and one of a red sub-pixel, a green sub-pixel, or a blue sub-pixel.

12. The display panel according to claim 10, further comprising a plurality of first switches and a plurality of second switches; wherein two sub-pixels in a first sub-pixel group are respectively connected to a first switch and a second switch; a control terminal of the first switch and a control terminal of the second switch are respectively connected to two different scan lines; and a first terminal of the first switch and a first terminal of the second switch are respectively connected to different data lines.

13. The display panel according to claim 12, wherein the first switch and the second switch each comprise a transistor.

14. A control method for controlling the display panel according to claim 1, comprising:

supplying driving signals to scan lines of the display panel to drive the first display area and the second display area.

15. The control method according to claim 14, wherein a duration time of each of the driving signals of the scan lines in the first display area is the same, and a duration time of each of the driving signals of the scan lines in the second display area is the same.

16. The control method according to claim 15, wherein the duration time of each of the driving signals of the scan lines in the first display area is shorter than the duration time of each of the driving signals of the scan lines in the second display area.

17. The control method according to claim 16, wherein the duration time of each of the driving signals of the scan lines in the first display area is one half of the duration time of each of the driving signals of the scan lines in the second display area.

18. A display apparatus, comprising the display panel according to claim 1.

19. The display apparatus according to claim 18, wherein the display apparatus is a mobile terminal comprising a sensor assembly; the first display area comprises a notch for accommodating the sensor assembly; and the notch constitutes the notched boundary.

* * * * *